US006241389B1

(12) United States Patent
Gilmore et al.

(10) Patent No.: US 6,241,389 B1
(45) Date of Patent: Jun. 5, 2001

(54) GIFT BAG DEVICE

(76) Inventors: Colleen Gilmore; Jason Gilmore, both of 5657 192nd Street, Surrey, BC V35 7M7 (CA)

( * ) Notice: Subject to any disclaimer, the term of this patent is extended or adjusted under 35 U.S.C. 154(b) by 0 days.

(21) Appl. No.: 09/489,567

(22) Filed: Jan. 21, 2000

(51) Int. Cl.[7] ..... B65D 33/28
(52) U.S. Cl. ..... 383/71; 383/117; 229/87.19
(58) Field of Search ..... 383/71, 72, 76, 383/22, 24, 117; 229/87.19

(56) References Cited

U.S. PATENT DOCUMENTS 3,599,690 * 8/1971 Christie ..... 383/72 X
4,608,283 * 8/1986 White ..... 383/76 X
4,777,066 * 10/1988 White et al. ..... 383/76 X
5,161,895 * 11/1992 Myers ..... 383/72
5,186,988 * 2/1993 Dixon ..... 383/71 X
5,456,062 * 10/1995 Wechsler ..... 229/87.19 X
5,551,570 * 9/1996 Shafferr et al. ..... 383/71 X
5,683,769 * 11/1997 Cheng ..... 383/72 X

FOREIGN PATENT DOCUMENTS 2 273 919 * 7/1994 (GB) ..... 383/71

* cited by examiner

*Primary Examiner*—Jes F. Pascua

(57) ABSTRACT

A gift bag device for containing and wrapping gifts. The gift bag device includes a bottom wall panel. A perimeter wall panel has a first edge and a second edge. The first and second edges are opposite edges. The first edge of the perimeter wall panel is fixedly coupled to a peripheral edge of the bottom wall panel. A cinching means closes an opening formed by the second edge of the perimeter wall panel.

1 Claim, 2 Drawing Sheets

GIFT BAG DEVICE

BACKGROUND OF THE INVENTION

1. Field of the Invention

The present invention relates to bags and more particularly pertains to a new gift bag device for containing and wrapping gifts.

2. Description of the Prior Art

The use of bags is known in the prior art. More specifically, bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Des. Pat. No. 156,059; U.S. Pat. No. 5,683,769; U.S. Pat. No. 5,551,570; U.S. Pat. No. 5,548,932; U.S. Pat. Des. No. 350,475; and U.S. Pat. No. 4,777,066.

While these devices fulfill their respective, particular objectives and requirements, the aforementioned patents do not disclose a new gift bag device. The inventive device includes a bottom wall panel. A perimeter wall panel has a first edge and a second edge. The first and second edges are opposite edges. The first edge of the perimeter wall panel is fixedly coupled to a peripheral edge of the bottom wall panel. A cinching means closes an opening formed by the second edge of the perimeter wall panel.

In these respects, the gift bag device according to the present invention substantially departs from the conventional concepts and designs of the prior art, and in so doing provides an apparatus primarily developed for the purpose of containing and wrapping gifts.

SUMMARY OF THE INVENTION

In view of the foregoing disadvantages inherent in the known types of bags now present in the prior art, the present invention provides a new gift bag device construction wherein the same can be utilized for containing and wrapping gifts.

The general purpose of the present invention, which will be described subsequently in greater detail, is to provide a new gift bag device apparatus and method which has many of the advantages of the bags mentioned heretofore and many novel features that result in a new gift bag device which is not anticipated, rendered obvious, suggested, or even implied by any of the prior art bags, either alone or in any combination thereof.

To attain this, the present invention generally comprises a bottom wall panel. A perimeter wall panel has a first edge and a second edge. The first and second edges are opposite edges. The first edge of the perimeter wall panel is fixedly coupled to a peripheral edge of the bottom wall panel. A cinching means closes an opening formed by the second edge of the perimeter wall panel. The cinching means may include a loop member securely coupled to the perimeter wall panel and an elongate flexible member. The elongate flexible member is removably extended through the loop member and tieable about the exterior surface of the perimeter wall panel. The elongate flexible member may comprise a ribbon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gift bag device apparatus and method which has many of the advantages of the bags mentioned heretofore and many novel features that result in a new gift bag device which is not anticipated, rendered obvious, suggested, or even implied by any of the prior art bags, either alone or in any combination thereof.

It is another object of the present invention to provide a new gift bag device which may be easily and efficiently manufactured and marketed.

It is a further object of the present invention to provide a new gift bag device which is of a durable and reliable construction.

An even further object of the present invention is to provide a new gift bag device which is susceptible of a low cost of manufacture with regard to both materials and labor, and which accordingly is then susceptible of low prices of sale to the consuming public, thereby making such gift bag device economically available to the buying public.

Still yet another object of the present invention is to provide a new gift bag device which provides in the apparatuses and methods of the prior art some of the advantages thereof, while simultaneously overcoming some of the disadvantages normally associated therewith.

Still another object of the present invention is to provide a new gift bag device for containing and wrapping gifts.

Yet another object of the present invention is to provide a new gift bag device which includes a bottom wall panel. A perimeter wall panel has a first edge and a second edge. The first and second edges are opposite edges. The first edge of the perimeter wall panel is fixedly coupled to a peripheral edge of the bottom wall panel. A cinching means closes an opening formed by the second edge of the perimeter wall panel.

Still yet another object of the present invention is to provide a new gift bag device that may be made in various sizes for different sized gifts.

Even still another object of the present invention is to provide a new gift bag device that contains a cinching means to give the package a ruffled look and to which a tag may be attached.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
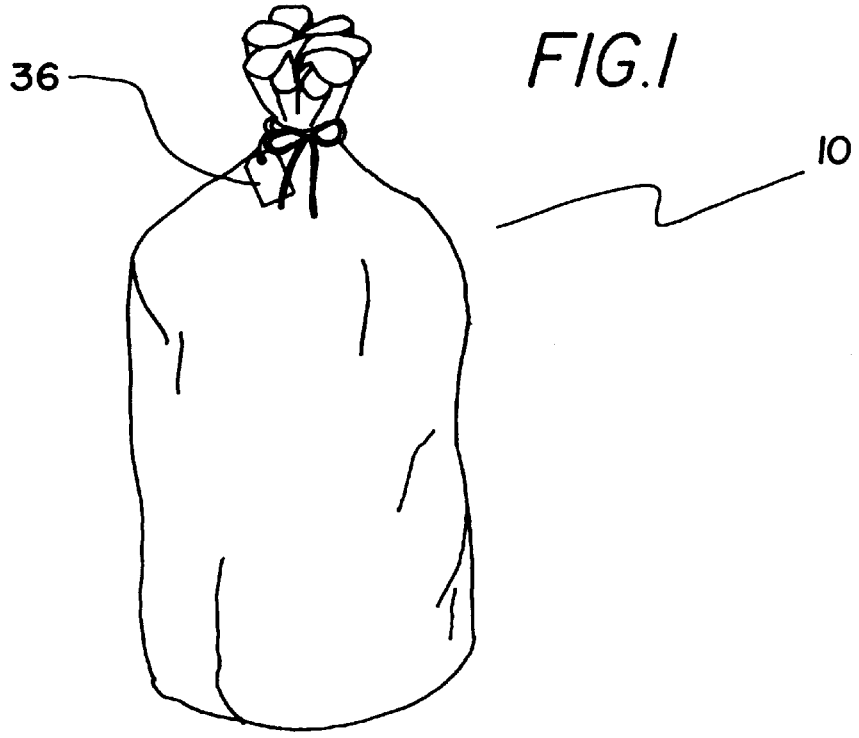
FIG. 1 is a schematic perspective view of a new gift bag device according to the present invention.
Figure 2:
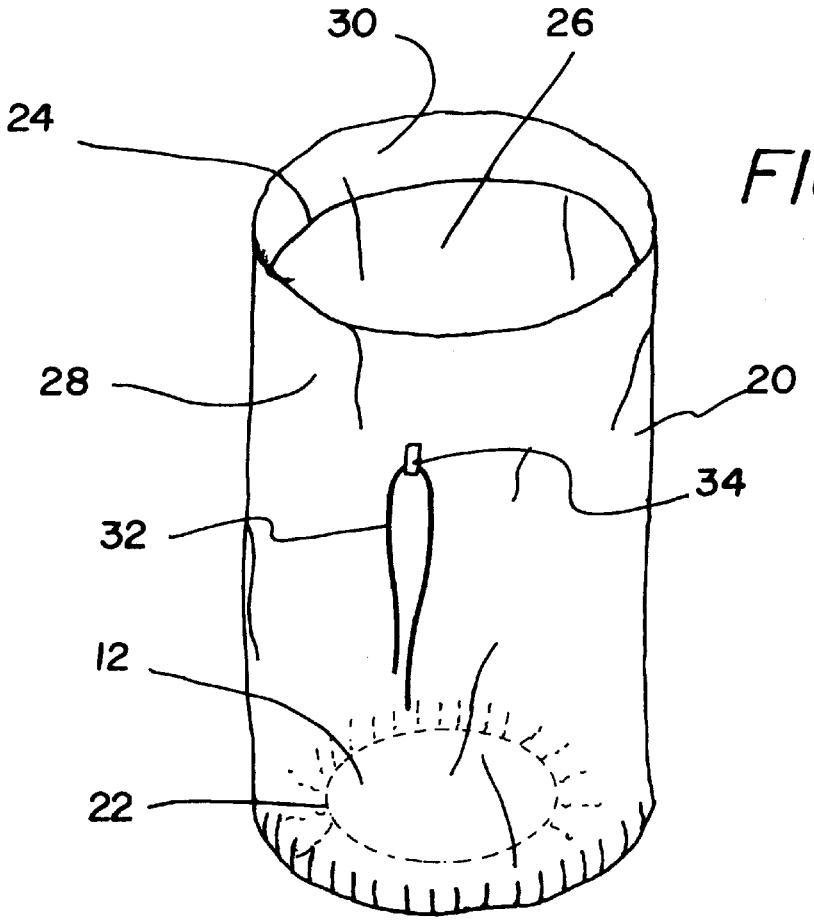
FIG. 2 is a schematic perspective view of the present invention.
Figure 3:
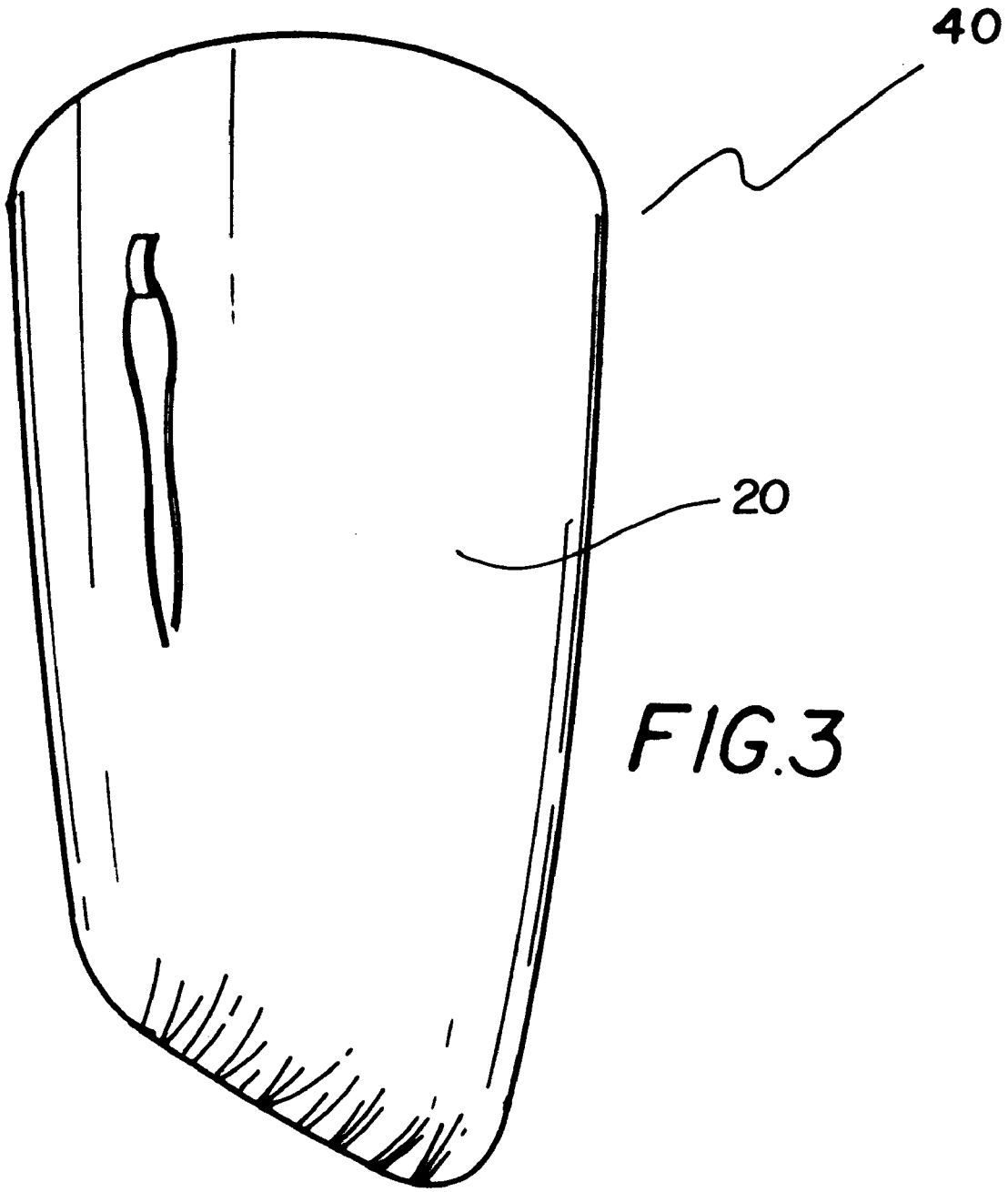
FIG. 3 is a schematic perspective view of the second embodiment of the present invention.

With reference now to the drawings, and in particular to FIGS. 1 through 3 thereof, a new gift bag device embodying the principles and concepts of the present invention and generally designated by the reference numeral 10 will be described.

As best illustrated in FIGS. 1 through 3, the gift bag device 10 generally comprises a bottom wall panel 12 and a perimeter wall panel 20. The bottom wall panel 12 has a generally circular shape. Preferably, the bottom wall 12 has a diameter between four and twelve inches. Ideally, the bottom wall panel 12 has a diameter substantially equal to eight inches which allows for holding of many items such as potted plants while not being too large and cumbersome. The bottom wall panel 12 is made from cloth. The cloth is preferably wool, cotton, linen, nylon or polyester.

The perimeter wall panel 20 has a first edge 22 and a second edge 24. The first 22 and second 24 edges are opposite edges. The perimeter wall panel 20 has an inside surface 26 and an outside surface 28. The first edge 22 of the perimeter wall panel is fixedly coupled to a peripheral edge of the bottom wall panel 12. The perimeter wall panel 20 is sewn to the peripheral edge of the bottom wall panel 12. The second edge 24 of the perimeter wall panel 20 forms a hem 30. The second edge 24 of the perimeter wall panel 20 is folded such that an inside surface 26 of the perimeter wall panel 20 abuts against itself. Ideally, the hem 30 has a height substantially equal to three inches for reasons which will become apparent. The perimeter wall panel 20 has a height between ten and twenty-four inched but ideally the height is substantially equal to fourteen inches. The perimeter wall panel 20 ideally has a circumference generally between twenty six inches and thirty inches. Generally, the circumference of the perimeter wall panel 20 should be at least five percent larger than the circumference of the bottom wall panel 12 so that the connection of the two creates a more attractive gathered look. The perimeter wall panel 20 is made from cloth. The cloth is preferably wool, cotton, linen, nylon and or polyester.

A cinching means 32 closes an opening formed by the second edge 24 of the perimeter wall panel 20. The cinching means 32 is an elongate flexible member adapted to be tied about the exterior surface 28 of the perimeter wall panel 20. Ideally, the cinching means 32 is a ribbon.

A hanging means 34 holds the cinching means 32. The hanging means 34 is a loop. The loop is fixedly coupled to the exterior surface 28 of the perimeter wall 20. The loop 34 is located generally adjacent to the hem 30. The cinching means 32 is run through the hanging means 34. The loop 34 is sewn such that the stitching is within the hem 30 and cannot be seen. By having a height of hem 30 of at least 3 inches, the loop stitching can be hidden while leaving enough cloth above the loop 34 for gathering the material when cinching it as is best depicted in FIG. 1.

A second embodiment 40, as depicted in FIG. 3, is generally identical to the first embodiment but has no bottom wall panel 12. In this embodiment, the inside surface of the perimeter wall panel 10 is gathered and sewn together.

In use, an article is placed in the bag 10 and cinched with the cinching means 32. In this fashion, the article can be given as a gift and a tag 36 may be tied to the cinching means.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A gift bag device, said device comprising:

a bottom wall panel, said bottom wall panel having a generally circular shape, said bottom wall panel having a diameter substantially equal to eight inches, said bottom wall panel being made from cloth, said cloth being chosen from the group of materials consisting of a wool, a cotton, a linen, a nylon and a polyester;

a perimeter wall panel, said perimeter wall panel having a first edge and a second edge, said first and second edges being opposite edges, said perimeter wall panel having an inside surface and an outside surface, said first edge of said perimeter wall panel being fixedly coupled to a peripheral edge of said bottom wall panel, said perimeter wall panel being sewn to said peripheral edge of said bottom wall panel, said second edge of said perimeter wall panel forming a hem, wherein said second edge of said perimeter wall panel is folded such that an inside surface of said perimeter wall panel abuts against itself, said hem having a height substantially equal to three inches, said perimeter wall panel having a height substantially equal to fourteen inches, said perimeter wall panel having a circumference generally between twenty six inches and thirty inches, said perimeter wall panel being made from cloth, said cloth being selected from the group consisting of a wool, a cotton, a linen, a nylon and a polyester; and a cinching means for closing an opening formed by said second edge of said perimeter wall panel, said cinching means including a loop member securely coupled to said perimeter wall panel and an elongate flexible member, said elongate flexible member being removably extended through said loop member and tieable about said exterior surface of said perimeter wall panel, said elongate flexible member being a ribbon.

* * * * *